United States Patent [19]

Groustra et al.

[11] Patent Number: 4,599,945

[45] Date of Patent: Jul. 15, 1986

[54] OUT-OF-LINE INTERRUPTER IGNITION SYSTEM FOR FLARES AND MARKERS

[75] Inventors: Edward P. Groustra, Ogden; Henry J. Roberts, Roy, both of Utah

[73] Assignee: Morton Thiokol, Inc., Chicago, Ill.

[21] Appl. No.: 665,863

[22] Filed: Oct. 29, 1984

[51] Int. Cl.[4] ..... F42C 15/18; F42C 15/34

[52] U.S. Cl. ..... 102/256; 102/260; 102/272

[58] Field of Search ..... 102/256, 254, 255, 258, 102/261, 260, 272, 275, 274, 222

[56] References Cited

U.S. PATENT DOCUMENTS

| | | | |
|---|---|---|---|
| 2,996,989 | 8/1961 | Grandy | 102/261 |
| 3,392,672 | 7/1968 | Noles | 102/256 |
| 3,657,958 | 4/1972 | Wells | 102/256 X |
| 3,736,877 | 6/1973 | Roberts et al. | 102/261 X |
| 4,393,780 | 7/1983 | Zacharin | 102/256 X |
| 4,449,454 | 5/1984 | Liebhardt et al. | 102/256 X |
| 4,483,250 | 11/1984 | Thurston et al. | 102/254 |

*Primary Examiner*—David H. Brown

*Attorney, Agent, or Firm*—Gerald K. White

[57] ABSTRACT

A hollow pivot pin, with an exposed primer at its side, holds boron potassium nitrate pellets 78 for igniting a flare. A spring-loaded firing pin mechanism is attached radially to the pivot pin and is swung about it by a parachute lanyard. When the firing pin becomes aligned with the primer charge, the firing pin is released and fires the charge.

6 Claims, 3 Drawing Figures

OUT-OF-LINE INTERRUPTER IGNITION SYSTEM FOR FLARES AND MARKERS

BACKGROUND OF THE INVENTION

1. Field of the Invention

This invention relates to flare ignition systems that may be used to ignite aircraft-launched parachute illuminating flares and may also be adapted for rocket deployment flares or other ordnance devices such as colored markers and gas generators. The invention is characterized by its provision of an ordnance safety feature that could possibly prevent catastrophic disasters (intense fires) tending to result from inadvertent or accidental ignition of the primer of the ignition system.

2. Description of the Prior Art

Many pyrotechnic devices such as military flares and rockets utilize the pulling of a lanyard to release a firing pin to effect ignition or to perform other functions that must executed after the pyrotechnic device clears a launcher or other hardware. A safety hazard exists with pyrotechnic devices of this type in that if a flare, for example, is dropped during handling or the lanyard inadvertently is caused to be pulled and the primer to be fired, a very serious accident can result.

In the prior art a number of proposals have been advanced for solving these problems. The patents and pending application discussed below are a representative sample of these proposals.

U.S. Pat. No. 2,392,884 granted Jan. 15, 1946 discloses a fuze for projectiles having safe and arm positions. There is included within the fuze body an unbalanced cylindrical detonator block which normally is held in a fixed safe position by a shear pin. Upon firing of the projectile, setback shears the shear pin and centrifugal force resulting from projectile rotation turns the unbalanced block to the armed position. In the armed position, a passage in the block allows flame and hot gas resulting from the impact of a firing pin and primer to communicate with a booster charge and thereby transmit detonation to a booster charge that fills the main body of the projectile. In the safe position, such communication is precluded by the unbalanced block.

A SAFE-ARM device for solid propellant rocket motors is disclosed in U.S. Pat. No. 3,529,418 granted Sept. 22, 1970. In this device there is provided a manually movable plug that in one position precludes accidental or inadvertent ignition of the motor, and in another position permits ignition of the motor on command. When in the safe position, the plug disperses to the atmosphere any gases or flame that result from accidental or inadvertent ignition, with spring tension means maintaining the plug in the safe position.

A similar SAFE-ARM device for solid propellant rocket motors is disclosed in U.S. Pat. No. 3,423,931 wherein the movable plug comprises a double ended piston that is movable in a tubular body and functions as a seal at either end of the body, with the toggle action of a spring maintaining the piston in the safe position.

An ignition system for air dropped illuminating flares triggered by the parachute shock pull on the ignition lanyard is disclosed in U.S. Pat. No. 3,736,877 granted on June 5, 1973. The ignition propellant is housed in plastic foam for protection and for absorbing the impact shock if the flare should inadvertently be dropped.

In U.S. Pat. No. 3,763,785 there is disclosed a safety device for an explosive train arming rotor type fuze comprising a dog that co-acts with the arming rotor to preclude mal-assembly of the fuze.

In copending U.S. application Ser. No. 485,083 filed Apr. 14, 1983 , now U.S. Pat. No. 4,483,250, assigned to the assignee of the present invention, there is disclosed a flare manual safety device comprising a cylindrical valve member that may be manually rotated, and in its safe position, forms a barrier between the firing pin-primer charge and the pyrotechnic ignition material for flares. The valving member has a passage through it that may be aligned with the firing pin-primer charge and the pyrotechnic ignition material in its armed position.

While there is recognition in the prior art, as above mentioned, of some of the desirable attributes of a flare ignition safety system or device, there remain problems with respect to locking the system in a safe condition and maintaining it in that condition to the end that accidental or otherwise unwanted firing of the primer during assembly and handling or caused by heat, shock or impact will not propagate to other ignition materials.

SUMMARY OF THE INVENTION

An object of the invention is to provide an improved flare safety system that, unless disassembled, can only be triggered by the pulling of a lanyard with a force equivalent to that of a parachute shock force during flare deployment.

Another object of the invention is to provide a redundant locking system for a flare safety system that prevents the firing pin housing of the ignition system from moving when a shock or impact load is applied to the flare.

In accomplishing these and other objectives of the invention, there is provided an out-of-line interrupter ignition system for flares and markers including a hollow pivot pin with an exposed primer charge in its side.

The pivot pin holds, interiorly thereof, boron pellets for igniting a flare. A spring-loaded firing pin mechanism is attached radially to the pivot pin and is swung in an arc about it by the parachute lanyard. When the firing pin becomes aligned with the primer charge, it is released and fires the charge.

BRIEF DESCRIPTION OF THE DRAWINGS

Having summarized the invention, a detailed description follows with reference being made to the accompanying drawings which form part of the specification, of which.

DESCRIPTION OF THE PREFERRED EMBODIMENT

Figure 1:
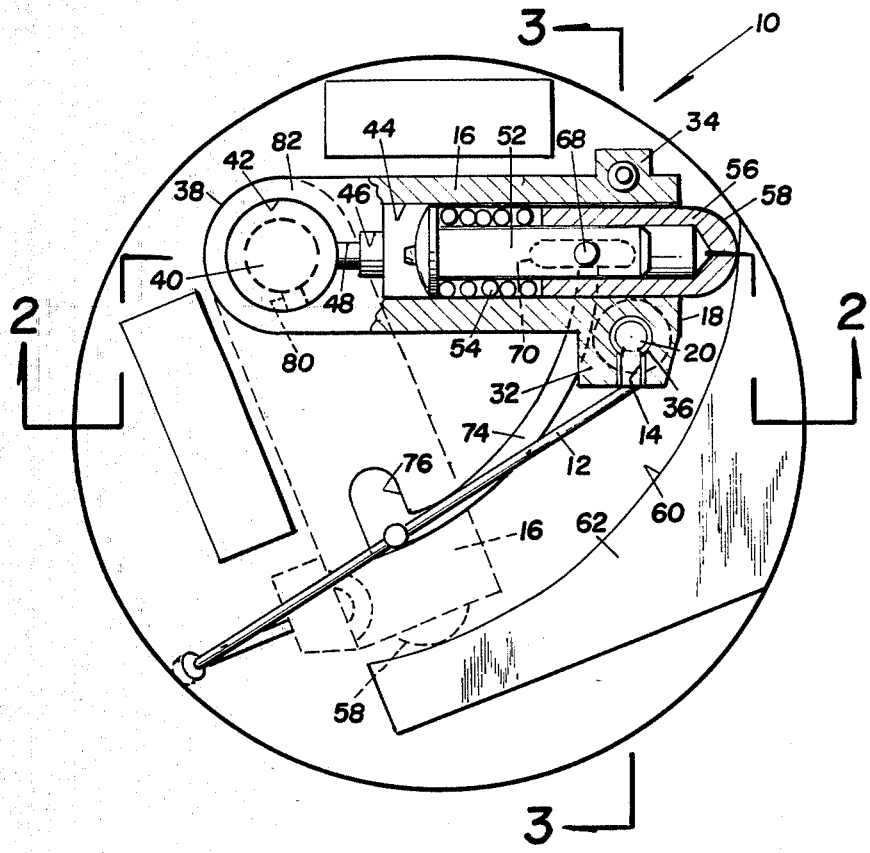
FIG. 1 is a plan view, partly in section, with the upper plate removed, of the out-of-line interrupter ignition system according to the present invention.

Referring to the drawings, an ignition system indicated generally by the reference numeral 10 includes an ignition lanyard 12. The lanyard 12 has one end fixedly attached by means (not shown) to a parachute cable (also not shown). The other end of the lanyard 12 is passed through a hole 14 in a first end 18 of an elongated firing pin housing 16 and is fixedly attached to a ball 20. Ball 20 is larger in diameter than hole 14 and is retained in a hemispherical recess 22 in a plate 24 by a retainer 26.

Figure 2:
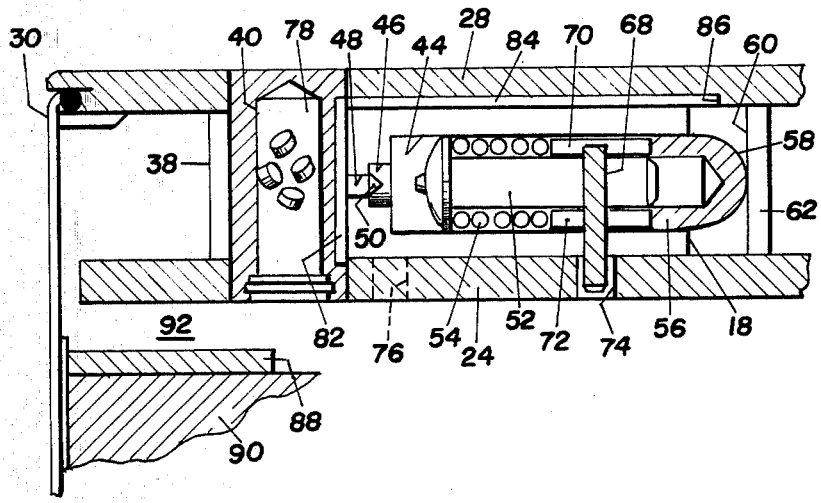
FIG. 2 is a view taken along the lines 2—2 of FIG. 1, showing, in addition, an upper plate for the ignition system.

By reference to FIG. 2 it will be seen that the firing pin housing 16 is supported between plate 24 and a plate 28 that is spaced upwards from and parallel thereto. Plate 24 forms a lower plate member for the ignition system 10 and plate 28 forms an upper plate therefor. The upper plate 28 may be configured to act as an end closure for the flare case indicated in FIG. 2 by numeral 30.

The firing pin housing 16, as shown in the drawing has a generally rectangular cross section. The first end 18 thereof, however, is provided with a first portion 32 that extends parallel to plates 24 and 28 to one side of housing 16 and with a second portion 34 that extends to the other side, thereof. The first portion 32 has the hole 14, through which the lanyard 12 is passed, formed therein and includes interiorly thereof an opening 36 that is larger in diameter than hole 14 sized so as to easily receive ball 20. On the side of housing 16, adjacent plate 24, the opening 36 is enlarged to receive the retainer 26.

A second end 38 of housing 16 is pivoted on a pivot pin 40 for rotation of housing 16 about pin 40 through an arc that is parallel to plates 24 and 28. The pivot pin 40 extends through a hole 42 in the end 38 of housing 16 with one end fixedly attached to lower plate 24 and the other end fixedly attached to upper plate 28.

Bores 44, 46 and 48 of successively reduced size are provided in housing 16, the bore 44 being the largest in diameter and extending from the first end 18 of housing 16 for a substantial portion of the length of the housing 16. Bore 46 is substantially smaller, both in diameter and length, than bore 44. Bore 48 is substantially smaller in diameter than bore 46 but may have about the same length, the bore 48 terminating at the hole 42 in the end 38 of housing 16. Inserted in bore 46 is a primer or priming charge 50 which, by way of example, may comprise a large rifle primer.

Contained within bore 44 is a firing pin 52, a firing pin helical spring 54 the inner end of which engages firing pin 52, and a cup shaped member 56 that embraces a portion of the firing pin 52. Member 56 is slideable with respect to firing pin 52 and also with respect to bore 44 of housing 16, the inner circular end of member 56 being in engagement with the outer end of the helical spring 54. A cam rider 58 is provided on the outer end of member 56.

As best seen in FIG. 1, cam rider 58 is in sliding engagement with a cam surface 60 than is provided on a member 62. Member 62, as seen in FIG. 2, is fixedly retained between the lower plate 24 and the upper plate.

The firing pin housing 16 is normally retained in the full line position shown in FIG. 1 by retainer 26 and a shear pin 64 that extends through a hole 66 in the second side portion 34 thereof into the lower plate 24. For convenience, this position of the housing 16 is, referred to hereinafter as the out-of-line position of the housing 16. Rotation of the housing 16 clockwise to the dotted line position shown in FIG. 1 is accomplished, as above mentioned, by pulling on the lanyard 12. Such rotation may be effected only by a pull of such force as first to pull ball 20 through retainer 26 and then to shear the shear pin 64. This position of the housing 16, for convenience, is termed the in-line position thereof. The cam surface 60 of member 62 is so shaped that as housing 16 is rotated from the out-of-line to the in-line position, the helical spring 54 is compressed to exert a force tending to drive the firing pin 52 forcefully toward the primer 50.

For preventing any movement of the firing pin 52 relatively to the primer 50 as the housing 16 is rotated from the out-of-line position to the in-line position, there is provided a roll pin 68 which extends through the firing pin 52, through upper and lower slots 70 and 72, respectively in member 56 and in an arcuate groove 74 that is formed in lower plate 24. Groove 74 extends in an arc of a circle with the pivot pin 40 at its center and in the in-line position has a release opening 76 that extends in the direction of pivot pin 40.

Pivot pin 40, as best seen in FIG. 2, is hollow and contains pellets 78 of an ignition booster such as boron potassium nitrate. A hole 80 provided in the wall of pivot pin 40 is in alignment with bores 44, 46 and 48 of firing pin housing 16, and hence, with primer 50, when the firing pin housing 16 is in the in-line position thereof, the pivot pin 40, as mentioned hereinbefore, being held fixed in position between plates 24 and 28. Angularly spaced counterclockwise from hole 80 on the cylindrical surface of the pivot pin 40 is a chordal recess 82 for venting gas from primer 50 in the event of accidental or inadvertent ignition of primer 50 with firing pin housing 16 in the out-of-line position. Chordal recess 82 is in communication with an auxiliary chamber 84 provided in ignition system 10 and formed by a recess 86 in the upper plate 28, as seen in FIG. 2. This structure precludes propagation of the ignition of the primer 50 to the pellets 78 and other ignition materials provided in the ignition system in the event of such undesired ignition of primer 50.

Figure 3:
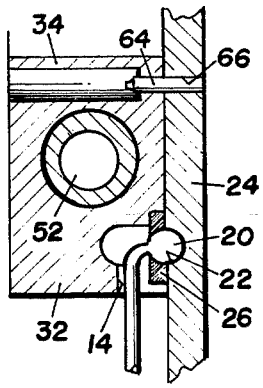
FIG. 3 is a view taken along the lines 3—3 of FIG. 1.

Pellets 78 in pivot pin 40, as shown in FIG. 3, are disposed in cooperative igniting relation with an ignition propellant 88 and a flare candle 90, being separated thereform by a relatively large space or void 92.

OPERATION OF THE PREFERRED EMBODIMENT

A timer mechanism (not shown) that may serve as an end closure for the ignition system 10 goes through its preset time cycle, releases and deploys the parachute (also note shown). The parachute opening shock force pulls the ignition lanyard 12 with the attached ball 20. The ball 20 is pulled through the retainer 26, pulls the firing pin housing 16, shears the shear pin 64 and rotates the housing 16 clockwise through an arc from the out-of-line to the in-line position thereof. Engagement of cam rider 58 on member 56 with the cam surface 60 compresses the firing pin helical spring 54 as the cam rider 58 follows the cam surface 60 from the out-of-line position to the in-line position of the housing 16. The roll pin 68 rides in groove 74 in the lower plate 24 and holds the firing pin 52 in its relative position with respect to primer 50 until the pin reaches the release opening 76, the firing position.

The firing pin 52, when released, strikes the primer 50, igniting the boron potassium nitrate pellets 78, which, in turn, ignite the propellant 88 and the flare candle 90.

The pivot pin 40 provides a bearing for the firing pin housing 16 to rotate on. The pivot pin 40 is also used as a container for the boron potassium nitrate pellets 78 and has the chordal recess 82 for primer gas venting in the out-of-line position.

The shear pin 64 prevents inadvertent actuation during handling and assembly of the flare. The ball 20, which is integral with the lanyard 12, and the retainer 26 provide an additional safety feature. The firing pin housing 16 can not be moved from its out-of-line position and started rotating until the ball 20 is pulled through the retainer 26.

Other safety features of the ignition system 10 may be summarized as follows:

1. The ignition system 10 can only be triggered by the shock force of the parachute during flare deployment. Triggering otherwise can be effected only by disassembly of the ignition system 10 and the application of a pull that exceeds 70 pounds exerted on the ignition lanyard 12.

2. A redundant locking system prevents the firing pin housing 16 from moving when a shock or impact load is applied to the ignition system 10.

3. The shear pin 64 cannot be sheared until the ball 20 is disengaged from the recess 22 in lower plate 24.

4. Firing of the primer 50 in the out-of-line position of housing 16 by heat, shock, or impact will not propagate to other ignition materials.

5. Gas venting of the primer 50 is provided in the event the primer 50 is inadvertently fired. This prevents flare ignition when the firing pin housing 16 is in the out-of-line position.

Thus, in accordance with the invention, there has been provided an out-of-line interrupter ignition system 10 for flares and markers that, unless disassembled, can only be triggered by a parachute shock force during flare deployment. The ignition system 10 is further characterized in that there is provided a redundant locking system that prevents the firing pin housing from moving relative to the ignition materials when a shock or impact load is applied to the system 10 or the flare associated therewith. Additionally, if the primer charge is inadvertently ignited in the out-of-line or safe position, the gases are vented into an auxiliary chamber away from the secondary igntion material and the flare candle.

What is claimed is:

1. An ignition system for flares comprising:

a lower plate, an upper plate, said upper plate being substantially parallel to said lower plate, a primer charge, a firing pin, a helical spring, a cup-shaped cam member, a hollow pivot pin extending between and fixed in position between said upper and lower plates, said pivot pin containing boron pellets therein for igniting a flare and having an opening in the side thereof exposing said pellets, an elongated firing pin housing having a first end and a second end with means at the first end for the attachment of a lanyard and being pivoted at said second end on said pivot pin, said housing having a plurality of bores of successively reduced size formed therein with the bore of largest size extending inwardly from said first end of said housing and the bore of smallest size being in communication with said pivot pin, said housing being adapted to be rotated around said pivot pin from an out-of-line position in which said bore of smallest size is angularly displaced from the opening in the side of the hollow pivot pin to an in-line position in which said bore of smallest size is aligned with the opening in the side of the hollow pivot pin, said primer charge being located in an intermediate one said bores, said firing pin being located in an innermost position in said bore of largest size and said cup-shaped cam member being located in an outermost position in said bore of largest size, said helical spring being positioned between and in engagement with both said firing pin and said cup-shaped cam member, a cam surface, said cup-shaped cam member having a cam rider at the outer end thereof in engagement with said cam surface, said cam surface being so shaped that as said housing is rotated about said pivot pin said cam member is moved inwardly of the largest bore in the housing and compresses said helical spring thereby to produce a force tending to impel said firing pin toward said priming charge; and means to prevent the firing pin from being impelled toward the priming charge until said bore of smallest size in said housing is in substantial alignment with the opening in the side of the hollow pivot pin exposing the boron pellets therein.

2. An ignition system as defined by claim 1, wherein said lower plate includes a recess adjacent the first end of said firing pin housing with said firing pin housing in its out-of-line position, said first end of said housing having a hole therein, a lanyard having a first end suitable for connection to a parachute and a second end that extends through the hole in said first end of said firing pin housing, a ball attached to the second end of said lanyard, said ball being larger in size than the hole and being positioned in said recess in said lower plate, and a retainer to normally retain said ball in said recess in said lower plate, whereby for rotation of said firing pin housing from said out-of-line position to said in-line position a shock force is required to be applied to the first end of the lanyard, said shock force having a magnitude at least sufficient to pull said ball through said retainer.

3. An ignition system as defined in claim 2 further including a shear pin connecting said first end of said firing pin housing to said lower plate whereby the shock force required for rotation of said firing pin housing from said out-of-line position to said in-line position must also be sufficient to shear said shear pin, said shear pin preventing inadvertent or accidental rotation of said firing pin housing to said in-line position and firing of said priming charge and actuation of the flare during handling and assembly of the flare.

4. An ignition system as defined in claim 1 wherein said means to prevent rotation of said firing pin housing until the bore of smallest size is in alignment with the opening in the side of the hollow pivot pin comprises an arcuate groove formed in said lower plate and extending between the out-of-line and in-line positions of said firing pin housing, said groove having a release opening extending toward said pivot pin at the end thereof in the in-line position of the firing pin housing, and a roll pin attached to said firing pin and having an end thereof extending into said groove, said cup shaped member having longitudinal slots formed therein through which said roll pin is operative to move radially toward said pivot pin as said roll pin enters said release opening of said groove thereby to allow the force produced by compression of said helical spring to impel said firing pin into firing engagement with said priming charge.

5. An ignition system as defined in claim 4 wherein said pivot pin includes in the exterior surface thereof a chordal recess, said chordal recess being spaced angularly with respect to the opening therein exposing the boron pellets, said chordal recess being in communciation with the smallest one of the bores in said firing pin housing, and further including, a recess in said upper plate in communciation with said chordal recess on said pivot pin, said recess in said upper plate forming an auxiliary chamber, whereby undesired firing of said priming charge due to heat, shock or impact with said firing pin housing in the out-of-line position will not propagate to the boron pellets in said pivot pin and to other ignition materials in the flare.

6. An ignition system as defined by claim 5 wherein said lower plate includes a recess adjacent the first end of said firing pin housing with said firing pin housing in its out-of-line position, said first end of said firing pin housing having a hole therein, further including, a lanyard having a first end and a second end that extends through the hole in said first end of said housing, a ball attached to the second end of said lanyard, said ball being larger in size than the hole in the first end of said housing and being positioned in said recess in said lower plate, a retainer normally retaining said ball in said recess in said lower plate, and a shear pin connecting said first end of said housing to said lower plate, whereby, for rotation of said housing from said out-of-line position to said in-line position, to actuate said igntion system a shock force on the first end of said lanyard of magnitude sufficient to pull said ball through said retainer and to shear said shear pin is required.

* * * * *